United States Patent [19]

Marton

[11] Patent Number: 4,729,292

[45] Date of Patent: Mar. 8, 1988

[54] AIR VENT

[75] Inventor: Lewis Marton, Randwick, Australia

[73] Assignee: Atlas Air Australia Pty. Limited, Rozelle, Australia

[21] Appl. No.: 927,005

[22] Filed: Oct. 29, 1986

[30] Foreign Application Priority Data

Nov. 22, 1985 [AU] Australia ..... PH3541

[51] Int. Cl.[4] ..... F24F 13/06

[52] U.S. Cl. ..... 98/40.01; 98/41.1; 98/103

[58] Field of Search ..... 98/31, 40.01, 40.12, 98/41.1, 102, 103

[56] References Cited

U.S. PATENT DOCUMENTS

| | | | |
|---|---|---|---|
| 2,135,810 | 11/1938 | Germonprez | 98/41.1 |
| 2,792,985 | 5/1957 | Heiman | 98/40.28 |
| 3,238,860 | 3/1966 | O'Day | 98/40.12 |
| 3,358,577 | 12/1967 | Thomson | 98/40.01 |
| 3,381,600 | 5/1968 | Getzin | 98/41.1 |
| 3,391,629 | 7/1968 | Snell | 98/103 |
| 4,073,110 | 2/1978 | Kennedy | 98/31 |

*Primary Examiner*—Albert J. Makay
*Assistant Examiner*—David W. Westphal
*Attorney, Agent, or Firm*—Bacon & Thomas

[57] ABSTRACT

An improved air vent (10) comprises a frame mounted from folded sheet metal, incorporating air dampers (23,24) in the bottom thereof and a plurality of square grills (21) located on supports (18,20) at the upper extremities of the frame. The frame includes four walls (11,12,13 & 14) which form a housing, and this housing is divided by barriers (16,17) into a number of chambers through which air passes. Each chamber has a grill (21) covering its upper opening and a pair of dampers (23,24) which adjustably control air flow through the chamber. Each grill 21 has a plurality of angled louvres 22 which divert the air to one side as it passes through the grill and the direction (A) in which the air is diverted is altered by rotating the grill within the housing. In this way different grills within the assembly may divert air flow through each grille (21) is adjusted by its respective dampers (23,24).

8 Claims, 3 Drawing Figures

AIR VENT

The present invention relates generally to air vents for air conditioning systems and in particular an improved floor air vent for use in under floor air conditioning systems of the type used in computer rooms and modern office installations.

In air conditioning systems where the air is distributed in a space under a raised tile floor of the area to be conditioned and is vented into the conditioned area via modular vents inserted in the floor, prior art vents have typically been mechanically complicated and expensive to manufacture. These prior art vents have also only allowed for one level of damping over the entire surface area of the vent and accordingly in situations where the vent size did not correspond with the size of an air intake for a particular piece of equipment, for example, it was often not possible to make efficient use of the conditioned air available.

The present invention consists in a modular air vent assembly comprising a rectangular frame having four closed sides, the frame being divided into a plurality of square sections by dividing plates located along the length of the assembly to separate the air flow of each section from its adjacent section and each section being provided with air damper means and a grill removably supported at the top of the respective section of the vent assembly, the vent assembly including support means adapted to rest on a supporting surface of a raised floor assembly, and each grill including louvres angled to direct air flow therethrough to one side and the grill being locatable in one of a plurality of orientations such that air flow can be directed in any one of a plurality of directions relative to the vent assembly each direction corresponding to a respective orientation of the grill.

In one embodiment of the invention, the vent assembly has the same length as a floor tile of a modular raised floor assembly, this being typically in the order of 600 millimeters, and the width of the vent assembly is an integral sub division of its length, typically in the order of 200 millimeters, the vent assembly being adapted to sit on stringers upon which floor tiles of the raised floor assembly would normally sit and the remainder of the square tile space in which the vent is positioned being occupied by either other vents of the same type or a floor tile of reduced size.

In a second embodiment of the invention, the vent assembly is smaller than the size of the modular floor tiles of the raised floor assembly and is adapted to be set into an opening in one of the floor tiles, this embodiment being particularly useful in installations where stringers are not used and the floor tiles sit directly on corner jacks. In this second embodiment, the length of the vent assembly will be less than the dimensions of the floor tile in which it sits and the width will once again be substantially an integral sub-division of the length.

In preferred embodiments of the invention, the air damper means, provided at the bottom of each section of the air vent assembly comprises one or more metal flaps adapted to cooperate to cover the bottom opening of the respective section, with at least one of the metal flaps being provided with perforations such that it is readily bendable along the perforation to provide an opening of variable cross section in the bottom of the respective section of the vent assembly.

Embodiments of the invention will now be described by way of example with reference to the accompanying drawings, in which.

Figure 1:
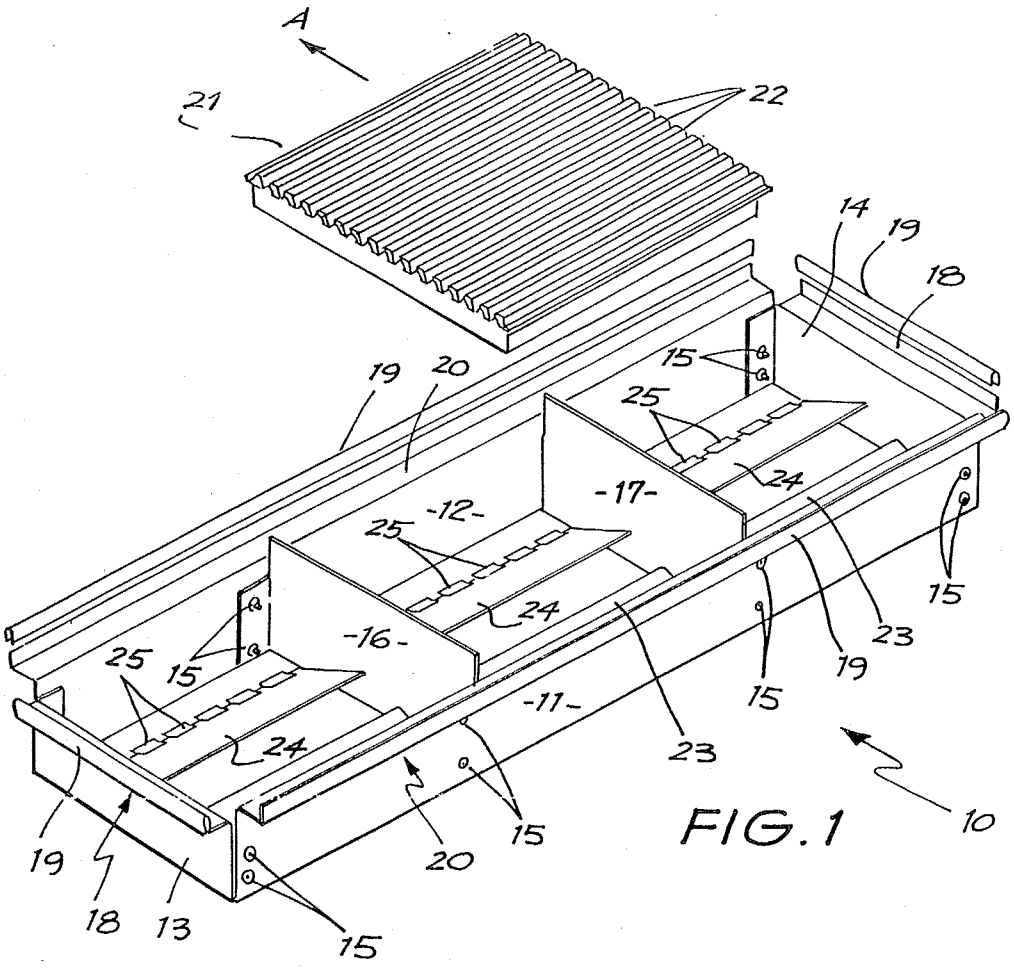
FIG. 1 illustrates a first embodiment of an air vent assembly made in accordance with the present invention.

Referring to FIG. 1, the air vent assembly 10 comprises a metal frame fabricated from four folded metal sides 11, 12, 13 and 14 which are connected together by pop rivets 15. Intermediate the length of the frame are two dividing partitions 16 and 17 which are also fabricated from folded metal sheet and are riveted to the sides 11 and 12 of the frame. Each of the sides 13 and 14 is folded at its top edge to form a lip 18 which is adapted to rest on a supporting stringer of the floor assembly into which the air vent is to be inserted, while each of the sides 11 and 12 has a lip 20 adapted to support a cover grill 21. Each of the lips 18, 20 has an upturned outer edge onto which a sealing strip 19 is placed in order to provide a relatively air tight seal between the edge of the air vent and adjacent tile or air vent assembly and in order to fill any unsightly voids which might otherwise be present.

Each of the sections defined by the partition 16 and 17 and the sides of the assembly is substantially square in shape and is adapted to receive a metal grill 21 on the upper surfaces of the lips 20 of the respective longer side walls 11,12 of the section, the upper surface of the grill 21 being substantially flush with the top surface of the sealing strips 19, and the grill being of sufficient strength to allow loading to the same level as the remainder of the floor into which the vent assembly 10 is placed. Although only one grill 21 is illustrated in FIG. 1 it will be recognised that three such grills are required to cover the air vent assembly illustrated therein. Further, the grill 21, being square, is adapted to be positioned in any one of four discreet rotational positions and the louvres 22 of the grill are angled to direct air to one side of the grill, as indicated by arrow A in FIG. 1. Therefore, by rotating the grill it is possible to change the direction of flow of the air leaving the vent, making it possible to direct the air to a particular piece of equipment or some other point in the room at which a higher air flow is desirable. By splitting the air vent assembly into three discreet air flow ducts, it is possible to direct air leaving the vent in three separate directions simultaneously, or alternatively a number of grills may be directed in the same direction to concentrate air flow at a particular site.

Each section of the air vent assembly is provided with a pair of damper flaps 23 and 24 which extend substantially horizontally from the sides 11 and 12 to control air flow through the respective section of the vent assembly. Each flap 23 and 24 is provided with a series of slotted perforations 25 which define a bending line along the flap, enabling the flaps to be opened and closed to regulate the air flow through the respective section. Accordingly, one section may be provided with a large air flow and the grill directed in a first direction and another section may be provided with a smaller air flow and the grill directed in a second direction corresponding to a piece of equipment which requires less cooling.

Figure 2:
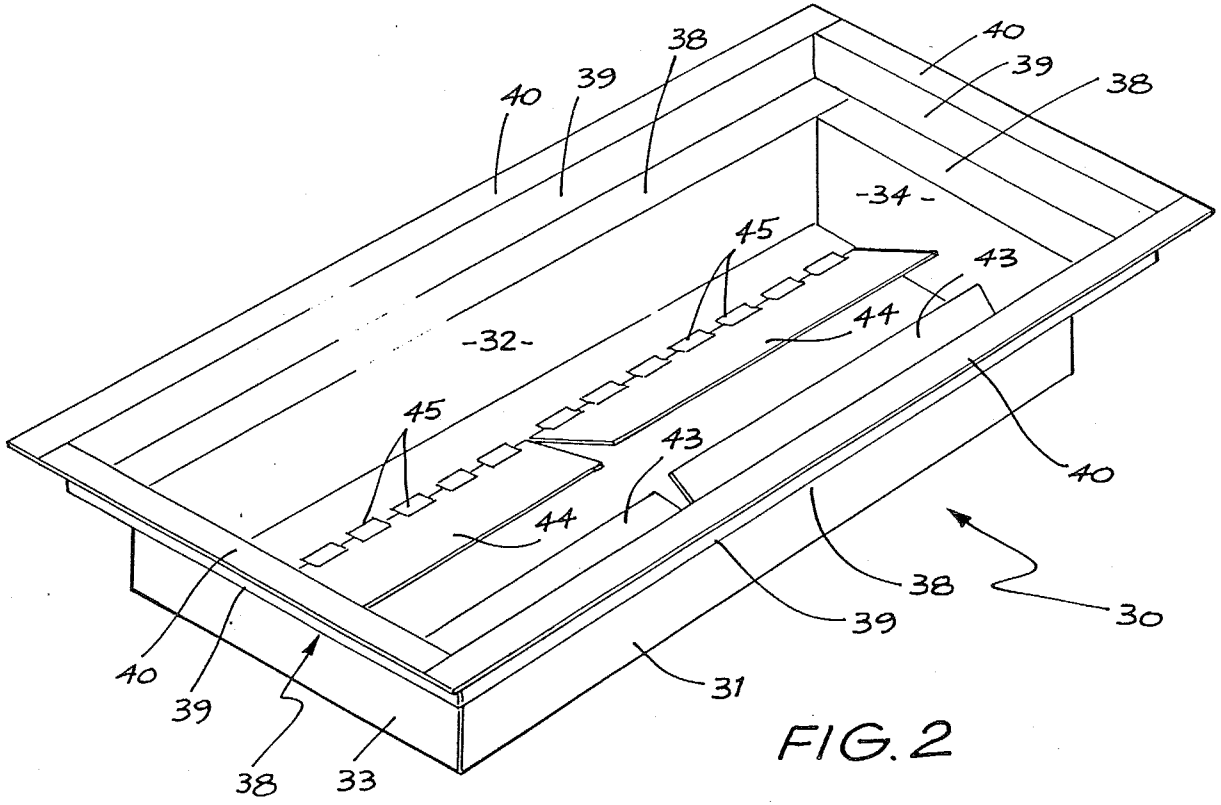
FIG. 2 illustrates a second embodiment of a vent assembly made in accordance with the present invention.

Referring now to FIG. 2, a second embodiment of the invention is illustrated, this embodiment being adapted for insertion into an opening in a floor tile in floor assemblies wherein the floor tiles sit directly on corner jacks with no intermediate stringers. It will be recognised that in such floor systems it is not possible to insert modular units which are sub units of one floor tile and therefore, as it is generally not necessary to have a vent which is as large as a standard floor tile, the embodiment of FIG. 2 has been devised to be inserted into an opening in a standard floor tile.

The vent assembly of FIG. 2 comprises four folded metal sides 31, 32, 33 and 34 which are welded together at each corner of the assembly. Each side 31, 32, 33 and 34 is provided with a substantially horizontal lip 38 extending outwardly therefrom and at the outer edge of the lip 38 is an upturned portion 39 and a further outwardly extending lip 40 at the top of the upturned portion 39. This structure is designed in order that the upper lip 40 can rest on the upper surface of the tile into which the vent is placed while the lower lip 38 provides a recessed supporting surface for a metal grill such as a grill 22 of FIG. 1.

The assembly of FIG. 2 is not shown as having intermediate dividing plates such as those shown in FIG. 1, however, it will be recognised by persons skilled in the art that such dividers could also be inserted in the grill of FIG. 2.

A number of flaps 43 and 44, similar to flaps 23 and 24 of FIG. 1 are also provided in the lower region of the assembly to control air flow through the vent and perforations 45 are provided to define a fold line about which the flaps are bent.

Figure 3:
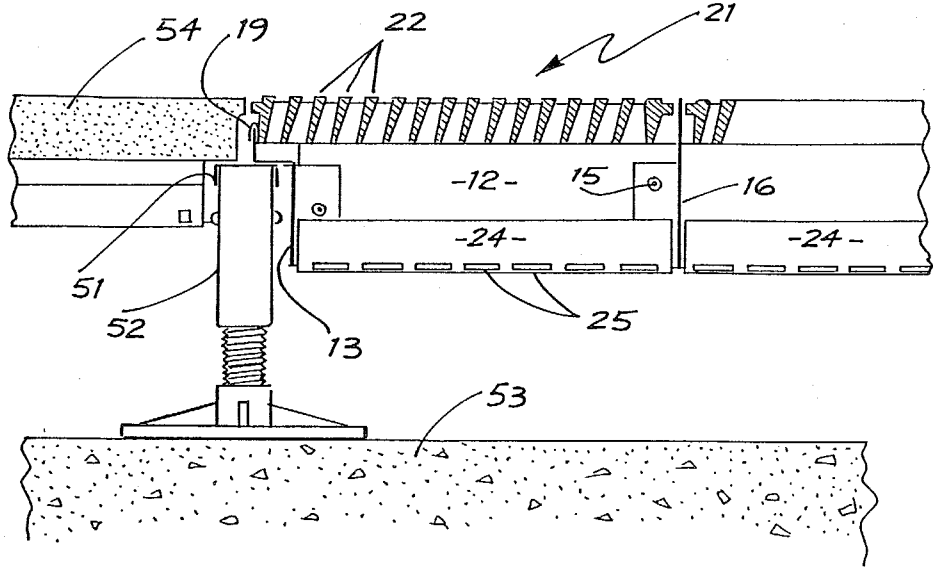
FIG. 3 illustrates a sectional view through the vent assembly of FIG. 1 when in position in a raised floor assembly.

A sectional view of the air vent assembly of FIG. 1, when fitted into a raised floor assembly, is illustrated in FIG. 3. In this drawing, the lip 18 is illustrated sitting on a stringer 51 which in turn sits on top of a corner jack 52 which serves to space the raised floor surface above the concrete floor slab 53. This drawing also illustrates the normal position of the grill 21 relative to an adjacent floor tile 54, when the grill sits on the lips 20 of sides 11 and 12 of the air vent assembly.

In preferred embodiments of the invention the air vent assembly of FIG. 1 will have a nominal length in the order of 600 millimeters and a nominal width in the order of 200 millimeters while the air vent assembly of FIG. 2 will have a nominal length in the order of 400 mm and a nominal width in the order of 200 millimeters.

It will be recognised by persons skilled in the art that numerous variations and modifications may be made to the invention as described above without departing from the spirit or scope of the invention as broadly described.

We claim:

1. A modular air vent assembly comprising a rectangular frame having four closed sides, the frame being divided into a plurality of individual square sections by dividing plates located along the length of the assembly to separate the air flow of each section from its adjacent section and each section being provided with a separate air damper means for controlling air flow through each section independently of the other sections and a grill removably supported at the top of the respective section of the vent assembly, the vent assembly including support means adapted to rest on a supporting surface of a raised floor assembly, and each grill including louvres angled to direct air flow therethrough to one side and the grill being locatable in one of a plurality of orientations such that air flow can be directed in any one of a plurality of directions relative to the vent assembly, each direction corresponding to a respective orientation of the grill.

2. The air vent assembly as claimed in claim 1 wherein the assembly has the same length as a floor tile of a modular raised floor assembly and the width of the vent assembly is an integral sub division of its length.

3. The air vent assembly as claimed in claim 2 wherein the length of the assembly is in the order of 600 millimeters and the width of the assembly is in the order of 200 millimeters.

4. The air vent assembly as claimed in claim 1 the assembly being adapted to sit on stringers upon which floor tiles of the raised floor assembly would normally sit.

5. The air vent assembly as claimed in claim 2, said assembly being smaller than the size of the modular floor tiles of the raised floor assembly and the air vent assembly being adapted to be set into an opening in one of the floor tiles and the width of the assembly being an integral subdivision of the length.

6. The air vent assembly as claimed in claim 5 wherein the length of the assembly is in the order of 400 millimeters and the width of the assembly is in the order of 200 millimeters.

7. The air vent assembly as claimed in claim 1 wherein the air damper means comprises one or more metal flaps adapted to cooperate to cover the bottom opening of the respective section, with at least one of the metal flaps being provided with perforations such that it is readily bendable along the perforation to provide an opening of variable cross section in the bottom of the respective section of the vent assembly.

8. The air vent assembly as claimed in claim 1, wherein the area covered by the grill is square such that the grill may be positioned in any one of four different rotational positions over a given section of the air vent assembly.

* * * * *